US005090146A

United States Patent [19]

Sandefur

[11] Patent Number: 5,090,146

[45] Date of Patent: Feb. 25, 1992

[54] REPOSITIONABLE SIGN FIGURES

[76] Inventor: Dennis L. Sandefur, 3107 S. Meridian St., Indianapolis, Ind. 46217

[21] Appl. No.: 742,062

[22] Filed: Aug. 6, 1991

Related U.S. Application Data

[63] Continuation of Ser. No. 188,847, May 2, 1988, abandoned.

[51] Int. Cl.[5] ..... G09F 7/02

[52] U.S. Cl. ..... 40/618; 40/595

[58] Field of Search ..... 40/594, 595, 615, 616, 40/618

[56] References Cited

U.S. PATENT DOCUMENTS

| | | | |
|---|---|---|---|
| 503,620 | 8/1893 | Schwartz | 40/618 |
| 544,564 | 8/1895 | Colburn | 40/618 |
| 906,959 | 12/1908 | Sternberg | 40/618 |
| 1,840,567 | 1/1932 | Chernow | 40/618 |
| 2,383,024 | 8/1945 | Tarbox | 40/618 |
| 2,524,294 | 10/1950 | Marsh | 40/615 |
| 2,595,970 | 5/1952 | McGill | 40/616 |

FOREIGN PATENT DOCUMENTS

| | | | |
|---|---|---|---|
| 1141778 | 9/1957 | France | 40/595 |
| 12082 | of 1890 | United Kingdom | 40/616 |
| 1800 | of 1911 | United Kingdom | 40/595 |
| 443627 | 3/1936 | United Kingdom | 40/594 |

*Primary Examiner*—Kenneth J. Dorner
*Assistant Examiner*—J. Bonifanti
*Attorney, Agent, or Firm*—Baker & Daniels

[57] ABSTRACT

Repositionable sign figure which may be adhesively affixed to a sign backboard comprising a sign figure comprised of a flexible, resilient material, and backwardly projecting flanges from the edges of said front surface, whereby a portion of the front surface of said sign figure may be depressed to adhesively affix said sign figure to said sign backboard. The sign figure is best suited for temporarily affixing a sign figure to a backboard by pressing a portion of the surface of the figure against backboard, and permanently affixing the sign figure to the backboard by pressing substantially the entire front surface of the figure against the backboard.

15 Claims, 2 Drawing Sheets

REPOSITIONABLE SIGN FIGURES

This is a continuation of copending application Ser. No. 07/188,847 filed on May 2, 1988, now abandoned.

FIELD OF THE INVENTION

The present invention relates to figures, such as letters, numerals and logos, that may be placed in any position on a backboard to create a sign. In particular, the present invention relates to sign figures which may be temporarily adhesively affixed to a sign backboard.

BACKGROUND OF THE INVENTION

The majority of sign backboards contain horizontal rails or slots to which sign figures, such as letters, numerals, logos and the like, may be affixed. With such devices, the sign figures must be affixed to the sign board in a vertical position—it is not possible to place the sign figures at any other angle of rotation. In addition, such boards usually accept only sign figures of a given height—differently sized sign figures may not be used on the same board.

If it is desired to place a sign figure on a backboard at a non-vertical angle of rotation, it is customary to apply adhesive to the back of the sign figure and affix the figure to the sign board. However, such methods have the universal shortcoming that it is difficult, if not impossible, to reposition the sign figures once the figures have been affixed to the sign board. Thus, it becomes necessary to carefully lay-out on the sign backboard the exact location where each sign figure will be placed. As such a process is very time consuming and does not allow for revisions, it would be preferable to devise a system so that the sign figures may be temporarily affixed to a sign board, then rearranged until the final location of each figure is determined, and then permanently affixed to the sign board.

OBJECTS OF THE INVENTION

One object of the invention is to provide a sign figure that may be affixed to a sign backboard on both a temporary and permanent basis.

Another object of the invention is to provide a sign figure that will leave a minimum amount of adhesive material on a sign backboard when it is relocated on the backboard.

Another object of the invention is to provide a sign figure which is light-weight.

Another object of the invention is to provide a sign figure that is inexpensive to manufacture.

Another object of the invention is to provide a flexible sign figure that may be affixed to a flexible sign board.

Still other objects and advantages of the invention will become apparent to those of skill in the art after reading the following description of a preferred embodiment.

SUMMARY OF THE INVENTION

The present invention comprises a repositionable sign figure which may be adhesively affixed to a sign backboard. The sign figure includes a front surface comprised of a flexible, resilient material, and backwardly projecting flanges from the edges of said front surface, whereby a portion of the front surface of said sign figure may be depressed to temporarily and adhesively affix said sign figure to said sign backboard. As only a small area of adhesive affixes the figure to the backboard, the figure may be peeled from the backboard and repositioned until a final location is selected. The figure may then be permanently affixed to the by pressing substantially the entire front surface of the figure against the backboard.

DETAILED DESCRIPTION OF THE PRESENT INVENTION

Figure 1:
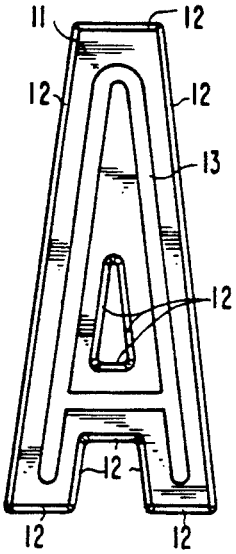
FIG. 1 is a view of the back of a repositionable sign figure of the invention with an adhesive applied thereto.

FIG. 1 is a view of the back of a repositionable sign figure of the invention with adhesive applied thereto. Sign FIG. 11 has a front surface (not shown) and is comprised of a flexible, resilient material. As described in greater detail below, the terms "flexible" and "resilient" as used herein refer to a sign figure that, in the absence of direct pressure on the front surface, will not allow adhesive applied to the back of the sign figure to extend below the edges of flanges 12 of sign FIG. 11. Therefore, adhesive 13 on the back of sign FIG. 11 will not normally contact a surface onto which the sign figure is placed. However, the "flexible" quality of the sign figure allow portions of the sign figure between flanges 12 to be depressed so that the back side of the front surface comes into contact with a sign board. If the sign figure is removed from a sign board, the "resilient" quality of the sign figure allows the previously depressed portion of the sign figure to assume its original configuration.

A sign figure as shown in FIG. 1 may be made as follows. A sheet of plastic, preferably 0.010–0.060 thick, is placed in a vacuum form machine. Such plastic is commercially available, one such source being that marketed under the trademark "Lustroform" by Johnson Plastics of Minneapolis, Minnesota. In the preferred embodiment, plastic 0.014 inch thick is used for sign figures less than several inches in height, and plastic 0.018 inch thick is used for larger sign figures.

A die, in the desired shape of the sign figure, is placed in the vacuum forming machine, and the plastic is removed from the machine and trimmed, preferably by die cutting, leaving a flange about the peripheral edges of the 8 figure. The height of the flange should be in the range of 1/16–3/16 in., depending on the size of the sign figure, and preferably ⅛ in.

Figure 2:
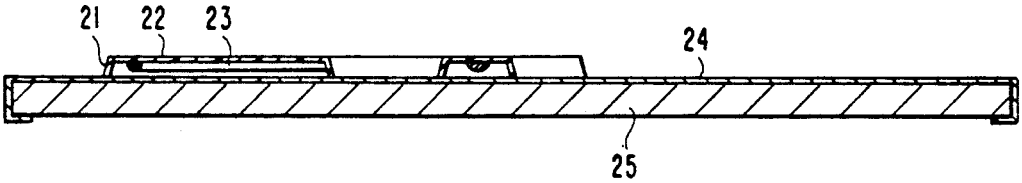
FIG. 2 is a sectional view of a sign figure of the invention placed on a sign board but which is not adhesively affixed to the sign board.

Tacky adhesive 13 is then applied to the back of the sign figure between the flanges. In the preferred embodiment, an adhesive sold under the tradename Roberts Monobond, a water based carpet adhesive, is applied and allowed to cure overnight to produce a tacky condition. As shown in FIG. 2, the sign figure is then placed on a wooden sign backboard 25, which is covered with a fabric 24, such as terrycloth or nylon carpet. Because the height of flanges 21 are greater than the thickness of adhesive 23, adhesive 23 does not contact sign board covering 24. FIG. 2 further shows how the resilient qualities of the sign figure prevent the sign figure from deforming and allowing the sign figure to come into contact with the sign backboard.

Figure 3:
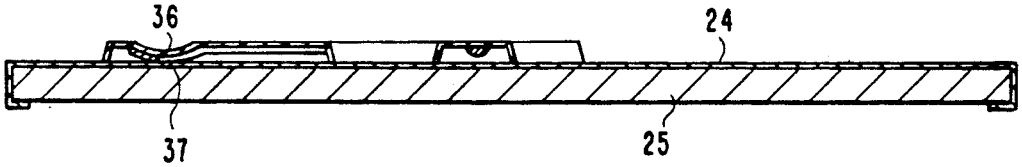
FIG. 3 is a sectional view of a sign figure of the invention temporarily affixed to a sign board.

FIG. 3 is a sectional view of a sign figure of the invention temporarily affixed to a sign board. Once a preliminary location on the board for the sign figure has been selected, the sign figure may be temporarily affixed to the sign board by pressing a portion of the front of the sign FIG. 36 to effect an adhesive bond between the sign figure and the backboard. As only a small portion of the sign figure becomes affixed to the backboard, the sign figure may be easily pulled off of the backboard and repositioned.

Figure 4:
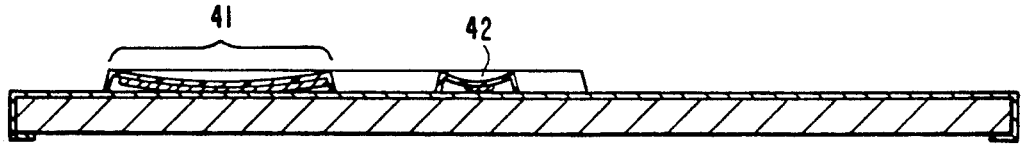
FIG. 4 is a sectional view of a sign figure of the invention permanently affixed to the sign board.

FIG. 4 is a sectional view of a sign figure of the invention "permanently" affixed to the sign board. By use of the word "permanently" it is not intended to suggest that the sign figure can never be removed from the sign board, but only that the sign figure will be securely affixed to the backboard so that the sign figure will not separate from the backboard in the environment in which the sign will be used. Such "permanent" affixation is effected by depressing the remaining portion of the front of the sign FIG. 41 and 42 to increase the surface area of contact between the adhesive and the sign backboard.

Figure 5:
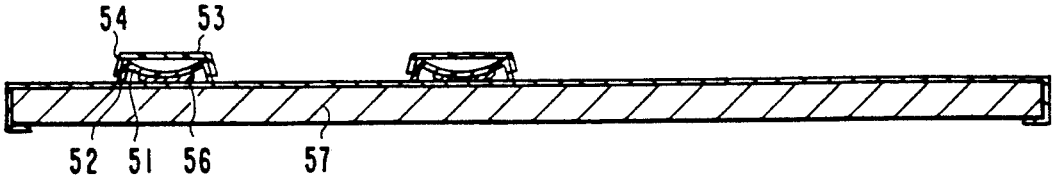
FIG. 5 is a sectional view of a sign figure of the invention stacked upon another sign figure.
Figure 6:
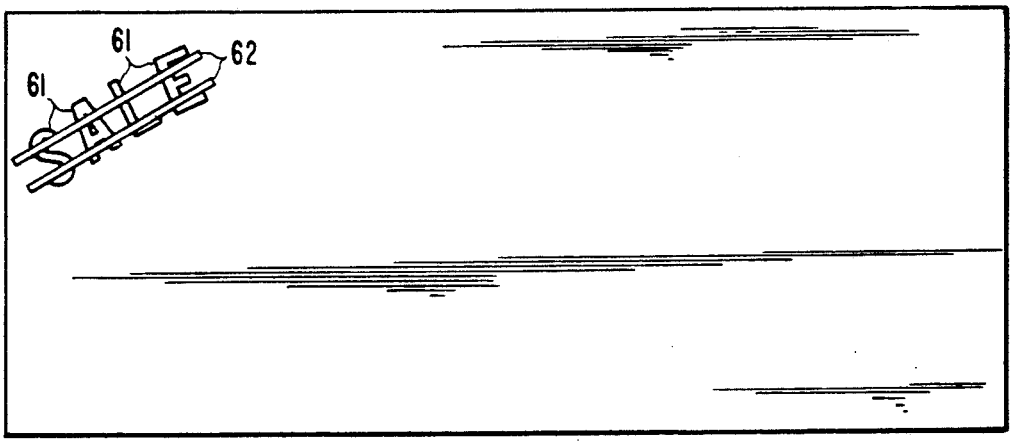
FIG. 6 is a perspective view showing strips of tape affixed to the top sign figures stacked as shown in FIG. 5.
Figure 7:
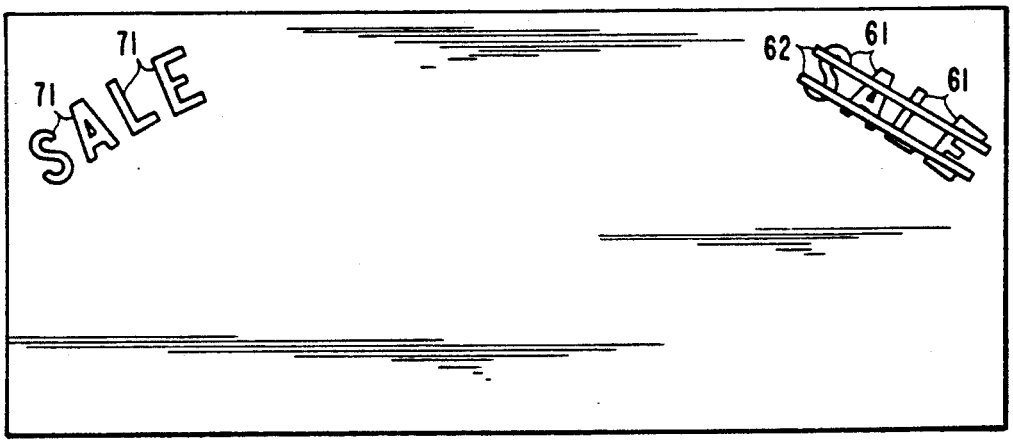
FIG. 7 is a perspective view showing how the arrangement of a set of sign figures may be easily duplicated on a sign board.

FIG. 5 is a sectional view of a sign figure of the invention stacked upon another sign figure. The manufacture of the sign figures as described above provides a sign figure in which flanges 52 and 54 project from front surface of the flange at an angle greater than perpendicular, thereby allowing the sign figures to be nested or "stacked" upon each other. This nestability feature allows relative positioning of multiple sign figures to be easily duplicated. This is done by affixing a first set of sign figures (71 in FIG. 7) to a sign board, then stacking a second set of identical sign FIGS. 61 on top of the first set 71. Two strips of tape 62 may then be placed across all of the sign figures in the second set. Tape 62 is lifted, maintaining second set 61 in their original relative position. Adhesive is then applied to the backs of the second set of sign figures as described above. The sign figures, with the tape still attached are then positioned in a second location on the same or another sign board. Finally, the center portions of the second set of sign figures are depressed to permanently affix said figures to said sign board.

The above described repositionable sign figure provides a device which may be used in a number of various configurations. For example, as the sign figures are flexible and constructed of light-weight plastic, they may be affixed to flexible sign boards such cloth banners. For such applications, it is recommended that a flexible adhesive, such as a silicon based adhesive, be used to affix the sign figures to the banner.

Many changes could be made in the above construction and many apparently widely different embodiments of this invention could be made without departing from the scope thereof, and it is intended that all matter contained in the above description or shown in the accompanying drawings shall be interpreted as illustrative and not in a limiting sense.

I claim:

1. A repositionable sign figure which may be adhesively attached to a sign backboard comprising:

a sign figure comprised of a flexible, resilient material; the sign figure having front and back sides;

peripheral edges of said sign figure having backwardly projecting flanges whereby said flanges normally cause said front surface to be spaced from a sign backboard when the sign figure is placed on said sign backboard;

adhesive disposed on the back side of said sign figure between the peripheral edges of the sign figure, the adhesive being thinner than the height of the flanges such that the sign figure is not affixed to a sign backboard prior to the front surface of the sign figure being depressed;

whereby a portion of the front surface between the peripheral edges of said sign figure may be depressed to adhesively affixed said sign figure to said sign backboard.

2. A repositionable sign figure of claim 1 wherein said adhesive and said sign backboard are flexible.

3. A repositionable sign figure of claim 1 wherein said sign figure is comprised of plastic.

4. A repositionable sign figure of claim 3 wherein the flanges of said sign figure are from about 1/16 inch to about 3/16 inch in height.

5. A repositionable sign figure of claim 1 wherein the flanges of said sign figure are from about 1/16 inch to about 3/16 inch in height.

6. The repositionable sign figure of claim 1 further comprising:

a sign backboard capable of receiving a sign figure.

7. A repositionable sign figure of claim 6 wherein said sign figure is comprised of plastic.

8. A repositionable sign figure of claim 7 wherein the flanges of said sign figure are from about 1/16 inch to about 3/16 in height.

9. A repositionable sign figure of claim 6 wherein the flanges of said sign figure are from about 1/16 inch to about 3/16 inch in height.

10. A repositionable sign figure of claim 1 wherein said flanges extend from said front surface by an angle greater than perpendicular such that to permit nesting of said sign figure with identical sign figures.

11. A method of affixing sign figures to a sign backboard comprising:

(a) providing sign figures of claim 1;

(b) placing said sign figures on said sign backboard;

(c) depressing a portion of the front surface between the backwardly projecting flanges of said sign figures to temporarily adhesively affix said sign figures to said backboards;

(d) repositioning said sign figures on said backboard by lifting at least one of said sign figures from said backboard, relocating each of said lifted sign figures on said backboard, and repeating step with each of said sign figures until all sign figures are in their desired final location;

(e) depressing substantially the entire front portion of said sign figures between the backwardly projecting flanges of said sign figures to adhesively affix and sign figures to said backboard.

12. The method of claim 11 wherein said sign figures are comprised of plastic.

13. The method of claim 12 wherein the flanges of said sign figures are from about 1/16 inch to about 3/16 inch in height.

14. The method of claim 11 wherein the flanges of said sign figures are from about 1/16 inch to about 3/16 inch in height.

15. A method of duplicating a set of nestable sign figures comprising:

(a) providing a first and a second set of nestable sign figures of claim 1;

(b) affixing said first set of sign figures to a surface in spaced relation;

(c) nesting said second set of sign figures over said first set of sign figures;

(d) adhesively affixing at least one common member to said second set of sign figures;

(e) lifting said second set of sign figures from said first set of sign figures such that the spaced relationship between said second set of sign figures is maintained by said common member;

(f) affixing said second set of sign figures to a surface while maintaining said spaced relationship between said second set of sign figures; and (g) removing said common member from said second set of sign figures.

* * * * *